United States Patent [19]

Edwards et al.

[11] 4,263,068

[45] Apr. 21, 1981

[54] TL-166 BLASTING AGENT

[75] Inventors: Donald W. Edwards, Provo, Utah; Thomas M. Zukovich, Palatine, Ill.; Ronald D. Thomas, Spanish Fork; Ronald M. Weigel, Salt Lake City, both of Utah

[73] Assignee: International Minerals & Chemical Corp., Terre Haute, Ind.

[21] Appl. No.: 53,129

[22] Filed: Jun. 28, 1979

[51] Int. Cl.[3] ..... C06B 45/00

[52] U.S. Cl. ..... 149/2; 149/89; 149/97

[58] Field of Search ..... 149/97, 2, 89

[56] References Cited

U.S. PATENT DOCUMENTS 3,713,915 1/1973 Fast ..... 149/89

*Primary Examiner*—Stephen J. Lechert, Jr.
*Attorney, Agent, or Firm*—Robert H. Dewey

[57] ABSTRACT

A blasting agent comprising ammonium nitrate, fuel, a nitroalkane and bentonite as a thickening agent.

17 Claims, No Drawings

TL-166 BLASTING AGENT

BACKGROUND OF THE INVENTION

This invention relates to an improved blasting agent. In a particular aspect this invention relates to a blasting agent characterized by high density with good sensitivity.

It is known from Lawrence, U.S. Pat. No. 2,325,064, to prepare an explosive composition from a nitroalkane of 1–3 carbon atoms, ammonium nitrate and a carbonaceous material such as wood flour, ivory meal, coal and the like. Such compositions proved satisfactory provided they were used promptly after preparation. However, they lost sensitivity with the passage of time and, hence, proved unreliable in field use. It was discovered that this loss of sensitivity was due to lack of affinity between the ammonium nitrate and the nitroalkane, so that the latter collected in the bottom portion of the container. The composition, therefore, became insensitive to the usual detonating devices. Accordingly, there exists a need for providing a means of maintaining a mixture of nitroalkane, ammonium nitrate and a carbonaceous material in a relatively homogeneous state. Also, advantageously the composition should have a high density so that it will sink in wet bore holes, i.e. holes having an appreciable water level.

SUMMARY OF THE INVENTION

It is an object of this invention to provide an improved blasting agent.

It is another object of this invention to provide an improved blasting agent having a high density with good sensitivity.

Other objects of this invention will be apparent to those skilled in the art from the description herein.

It is the discovery of this invention to provide an improved blasting agent comprising ammonium nitrate, a nitroalkane, fuel oil and bentonite as a thickener therefor. The composition is characterized by high density, good sensitivity, and retains sensitivity well.

DETAILED DESCRIPTION

The blasting agent of this invention comprises ammonium nitrate in an amount of about 86% by weight mixed with about 10% by weight of a fuel composition and about 4% of a thickening agent therefor. It is understood that these quantities are the preferred quantities. It is not intended they be precise and considerable variation therefrom is permissible without adversely affecting the sensitivity. For example, the fuel may vary form about 8 to about 14%, and the bentonite may vary from about 2 to about 8%; the remainder being ammonium nitrate.

The fuel component of the blasting agent comprises a mixture of nitroalkane of 1 to 3 carbon atoms and fuel oil in a ratio of from about 1:1 by weight to about 4:1. The nitroalkane can be nitromethane, nitroethane, or preferably nitropropane, or mixtures thereof. Either 1-nitropropane or 2-nitropropane may be used with equally good results. When nitromethane is used as the nitroalkane, the mixture is sufficiently shock sensitive to be classified as an explosive by Department of Transportation tests. When nitroalkanes of 2–3 carbon atoms are used, the sensitivity is that of nitro-carbo-nitrates.

The fuel oil useful in the practice of this invention is known in the art and any type of such oil is suitable. The invention is not limited to any particular type or grade.

However, the grade known as No. 2 is commonly used in the art and is suitable for the practice of this invention.

The ammonium nitrate used in the practice of this invention is a mixture of low density, explosive grade ammonium nitrate prills, as known in the art, and comminuted material. The comminuted ammonium nitrate can be used in an amount of from 20% to 80% of the total, preferably 50% by weight.

The bentonite used in the practice of this invention can be either the Southern or the Western type in an amount of about 2 to about 8% of the total composition, preferably about 4%. Preferably, the bentonite is comminuted, e.g. about −200 mesh. The bentonite is primarily useful in preventing the liquid fuel component from draining off the ammonium nitrate solids and puddling in the bottom of the bag. In the absence of bentonite, this puddling develops rather rapidly on standing and the mixture becomes insensitive, failing to detonate when initiation is attempted. The bentonite has the added advantages contributing to a higher density mixture and tending to stabilize it to shock without unduly desensitizing it.

The composition of this invention is readily prepared by mixing the ingredients in a conventional manner and discharging the mixture into suitable containers, e.g. plastic bags.

The composition is especially useful in bore holes. It is heavier than water, so if water collects in the bore hole, the blasting agent sinks without difficulty. It can be detonated by the usual boosters and primers, as known in the art, preferably a cast primer. Also at least two primers should be used in each column of blasting agent, and under extremely severe loading conditions, or where powder column separations ae possible, additional primers should be used to preclude cutoffs.

The composition has a detonation rate, 5 in. diameter unconfined, of 11,250 feet per second and a detonation pressure of 34 Kbar. It is not cap sensitive and is not detonated by the impact of a 30 calibre rifle bullet.

Typically it will have the following composition and properties.

| | | |
|---|---|---|
| Ammonium nitrate | | 86% |
| Whole prills | 43% | |
| Ground prills | 43% | |
| Nitroalkane | | 5% |
| Fuel oil | | 5% |
| Bentonite | | 4% |
| | Total | 100% |
| Specific gravity, min. | | 1.10 |
| Density | | 1.22 |
| Rate of detonation* | | 11,250 fps |
| Detonation pressure* | | 34 Kbar |

*5 in. diameter unconfined

It is an embodiment of this invention to provide a finished, packaged blasting agent comprising the blasting agent described hereinbefore packaged in a nylon bag of from 4 to 8 inches in diameter. The nylon is at least 1.25 mil thickness, there being no upper limit as to thickness. However, 1 mil thickness nylon film is relatively easily torn and punctured and because heavier gauge nylon is relatively expensive, it is preferred to employ the nylon bag in conjunction with polyethylene. The nylon can be laminated to the polyethylene or it can merely be formed into a bag heat sealed at one end and inserted in a polyethylene bag, also heat sealed at one end. Such a packaging system wherein the nylon is of from 1 to 2 mil and the polyethylene is from 4–5 mil has proven very successful.

Nylon is the only film so far discovered which will contain nitroalkanes for a satisfactory shelf-life period. All others tested have apertures and voids, which, though microscopic, are sufficient to permit the nitroalkane to evaporate and the blasting agent thereby becomes insensitive and useless.

The invention will be better understood with reference to the following examples. It is understood, however, that the examples are intended only to illustrate the invention, and it is not intended that the invention be limited thereby.

EXAMPLE 1

A sample of explosive grade, uncoated, prilled ammonium nitrate was ground through a ⅛inch screen manufactured by the Gruendler Corporation. The comminuted material was mixed wth unground prills in a 1:1 by weight ratio. The mixture had the following screen analysis:

| | |
|---|---|
| +18 | 58.75% |
| +35 | 16.25% |
| +60 | 12.5% |
| +80 | 3.75% |
| +120 | 3.75% |
| +230 | 3.75% |
| −230 | 1.25% |

The mixed ammonium nitrate, 86 g, was then mixed with No 2 fuel oil 2.8 g, 2-nitropropane 6.5 g and 200-mesh bentonite 4.7 g. The mixture had a standard density of 1.32 and after standing 24 hours was sensitive to the shock of 20 g of Pentolite (a mixture of pentaerythritol tetranitrate and trinitrotoluene). The unconfined rate of detonation in a 3-inch diameter column was 2691 m/sec (8826 ft/sec) and in a 1.5″×12″ pipe, it was 3355.5 m/sec (11,006 ft/sec).

The mixture was used to fill a four and one-half inch diameter nylon bag of 1.25 mil thichness, heat sealed on one end and encased in a 4 mil polyethylene bag. The 2-NP and fuel oil did not drain away and pool at the bottom and the mixture retained good sensitivity on standing. A similar mixture but wthout the bentonite was prepared and similarly packaged in a nylon bag with polyethylene outer bag. Upon standing a brief period, the liquid portion drained away from the ammonium nitrate in the upper portion of the bag and puddled in the bottom of the bag. The mixture was insensitive and did not detonate on initiation.

EXAMPLE 2

The experiment of Example 1 was repeated in all essential details except that a 1:1 mixture by weight of 1-nitropropane (1-NP) and 2-nitropropane (2-NP) was used in place of 2-NP alone. The resulting mixture was satisfactory in all respects.

EXAMPLE 3

The experiment of Example 1 was repeated in all essential details except that 1-nitropropane was substituted for the 2-nitropropane. The resulting mixture was satisfactory in all respects.

EXAMPLE 4

The experiment of Example 1 was repeated in all essential details except that nitroethane was substituted for the 2-nitropropane. The resulting mixture was satisfactory in all respects.

EXAMPLE 5

The experiment of Example 1 is repeated in all essential details except that the 2-nitropropane and fuel oil are used in equal parts by weight. The resulting mixture was satisfactory in all respects.

EXAMPLE 6

The experiment of Example 1 is repeated in all essential details except that nitromethane is used as the nitroalkane. The resulting mixture is satisfactory in all respects. It is sensitive to the shock of a No. 8 cap.

We claim:

1. A blasting agent comprising ammonium nitrate, a fuel and a thickener therefor, the fuel comprising a nitroalkane of 1 to 3 carbon atoms and fuel oil and the thickener comprising bentonite.

2. The composition of claim 1 wherein the fuel component is present in an amount of about 8–14% by weight of the composition.

3. The composition of claim 2 wherein the fuel component is present in an amount of about 10% by weight of the composition.

4. The composition of claim 2 wherein the nitroalkane is 1-nitropropane.

5. The composition of claim 2 wherein the nitroalkane is 2-nitropropane.

6. The composition of claim 2 wherein the fuel component consists of nitroalkane in a ratio of about 1–4:1 parts by weight.

7. The composition of claim 1 wherein the bentonite is present at about 2–8% by weight.

8. The composition of claim 1 wherein the ammonium nitrate consists of comminuted ammonium nitrate and granular ammonium nitrate in a ratio of about 80–100:20–0 respectively.

9. The composition of claim 8 wherein the ammonium nitrate is 100% comminuted.

10. The composition of claim 8 wherein the ammonium nitrate consists of 80% comminuted and 20% prilled.

11. The composition of claim 10 wherein the bentonite is present in an amount of from 2–8% by weight.

12. The composition of claim 11 wherein the bentonite is present in an amount of about 4% by weight.

13. A packaged unit of the blasting agent of claim 1 comprising the blasting agent packaged in a nylon bag of 4–8 inches diameter.

14. The packaged unit of claim 13 wherein the nylon bag is encased in a polyethylene bag.

15. The packaged unit of claim 14 wherein the nylon is of 1–2 mil thickness and the polyethylene is of from 4–5 mil thickness.

16. The composition of claim 8 wherein the comminuted ammonium nitrate and prilled ammonium nitrate are in a ratio of about 1:1.

17. The composition of claim 1 wherein the fuel oil component is miscible with the nitroalkane.

* * * * *